US005078392A

United States Patent [19]

Kracht

[11] Patent Number: 5,078,392

[45] Date of Patent: Jan. 7, 1992

[54] WEIGHT LIFTING BAR APPARATUS WITH ROTATABLE SLEEVE ELEMENT

[76] Inventor: James F. Kracht, 16650 N. 43rd St., Phoenix, Ariz. 85032

[21] Appl. No.: 624,578

[22] Filed: Dec. 10, 1990

[51] Int. Cl.[5] ..... A63B 21/072

[52] U.S. Cl. ..... 272/123

[58] Field of Search ..... 272/122, 123

[56] References Cited

U.S. PATENT DOCUMENTS

| | | | |
|---|---|---|---|
| 2,470,816 | 5/1949 | Harvey | 27/84 |
| 3,756,597 | 9/1973 | Monti | 272/81 |
| 3,904,198 | 9/1975 | Jones | 272/81 |
| 4,043,553 | 8/1977 | Suarez | 272/128 |
| 4,231,569 | 11/1980 | Rae | 272/122 |
| 4,361,324 | 11/1982 | Baroi | 272/94 |
| 4,455,020 | 6/1984 | Schnell | 272/123 |
| 4,579,337 | 4/1986 | Uyeda | 272/123 |
| 4,775,147 | 10/1988 | Bold, Jr. | 272/127 |
| 4,787,629 | 11/1988 | DeMyer | 272/123 |
| 4,867,444 | 9/1989 | Castillo | 272/123 |
| 4,893,810 | 1/1990 | Lee | 272/123 |

FOREIGN PATENT DOCUMENTS

| | | | |
|---|---|---|---|
| 151840 | 10/1920 | United Kingdom | 272/123 |
| 1588973 | 5/1981 | United Kingdom . | |

*Primary Examiner*—Richard J. Apley
*Assistant Examiner*—L. Thomas
*Attorney, Agent, or Firm*—H. Gordon Shields

[57] ABSTRACT

Weight lifting apparatus includes a bar to which weights are fixedly secured. The weights are spaced apart from each other and a rotatable sleeve is disposed about the bar between the weights. A pair of collars supports the rotatable sleeve, and the weights are disposed against the collars supporting the sleeve. The collars are secured to the bar.

3 Claims, 1 Drawing Sheet

WEIGHT LIFTING BAR APPARATUS WITH ROTATABLE SLEEVE ELEMENT

BACKGROUND OF THE INVENTION

1. Field of the Invention

This invention relates to weight lifting apparatus and, more particularly, to weight apparatus utilizing weights secured to a bar and a rotatable sleeve secured to the bar.

2. Description of the Prior Art

Generally, the weight lifting apparatus of the prior art utilizing a bar comprises simply a bar to which weights are secured by a pair of collars. The collars are secured on opposite sides of the weights, typically by set screws or the like. The bar is grasped by the user and the bar and weights comprise a single unit in the hands of the users.

On some weight lifting bars, the weights include bearings so that the weights rotate with respect to the bar, but the bar itself is rigid with respect to the user.

U.S. Pat No. 2,470,816 (Harvey) discloses an exercise apparatus in which there are a pair of hand grips, one fixed at one end of a bar, and another hand grip movable relative to the bar.

U.S. Pat. No. 3,756,597 (Monti) discloses exercise apparatus in which a pair of hand grips are secured to a bar adjacent to the ends of the bar, with weights extending in a pendulum fashion downwardly from the ends of the bar. The weights move or pivot relative to the bar on bearing material. U.S. Pat. No. 3,904,198 (Jones) discloses exercise apparatus of a configuration generally similar to that of the '597 ( Monti) patent. The '198 (Jones) patent utilizes a pair of hand grips secured to a bar, and the hand grips are freely rotatable relative to the bar.

U.S. Pat. No. 4,043,553 (Suarez) discloses an exercise apparatus which also utilizes a pair of hand grips that are rotatable or moveable relative to a bar. Again, weights extend downwardly from opposite ends of the bar, similar to the general concept of both the '597 (Monti) patent and the '198 (Jones) patent.

U.S. Pat. No. 4,231,569 (Rae) discloses an exercise frame apparatus that utilizes dumbbells and some type of a bearing system. Details of the bearings are not disclosed.

U.S. Pat. No. 4,361,324 (Baroi) discloses a freely rotating sleeve disposed about a connecting bar in a dumbbell embodiment.

U.S. Pat. No. 4,455,020 (Schnell) discloses the use of low friction bearing sleeves to support weights on a bar. The sleeves allow the weights to rotate relative to the bar.

U.S. Pat. No. 4,775,147 (Bold, Jr.) discloses a wheel rotatable mounted on a sleeve, and the sleeve in turn rotates about a bar. A weight is secured to the wheel.

British patent 151,840 (Pullum) discloses weight lifting apparatus in which there are a plurality of sleeves disposed about a central bar. Included in the various sleeves are hand grips which rotate relative to the bar.

British patent 1,588,973 (Castle) discloses deformable sleeves rotatably mounted on a shaft. The sleeves are radially deformable between their ends to provide frictional resistance to the rotation of the sleeves.

In the above discussed patents, either the weights rotate relative to the bar, or fixed hand grips rotate relative to the bar. In the apparatus of the present invention, a central sleeve rotates relative to a bar, and the weights are fixed to the bar. The utilization of the rotatable sleeve allows the placement of the users hands at any desired location on the sleeve and convenient for a particular user for a particular exercise, and permits a more fluid motion of the user in raising the bar and weights while exercising. A more coordinated movement is possible because the user lifts only weight without any rotary forces of the weights on the bar wording against the user. Moreover, weight lifting exercises may be accomplished without the rasping noise of the weights on the bar in prior art apparatus as the weights move relative to the bar, or as they attempt to move relative to the bar.

SUMMARY OF THE INVENTION

The invention described and claimed herein comprises weight lifting apparatus in which weights are secured to a central bar, and a tubing or sleeve element is secured between a pair of collars which are in turn secured to the bar. The sleeve or tubing element rotates relative to the bar and to the weights.

Among the objects of the present invention are the following:

To provide new and useful weight lifting apparatus;

To provide new and useful weight lifting apparatus in which a sleeve is rotatable relative to a bar;

To provide new and useful apparatus in which a pair of collars is secured to a bar, and sleeve is rotatably secured between the collar; and To provide new and useful weight lifting apparatus in which weights may be fixedly secured to a bar, and a hand grip is rotatably secured to the bar.

DESCRIPTION OF THE PREFERRED EMBODIMENT

Figure 1:
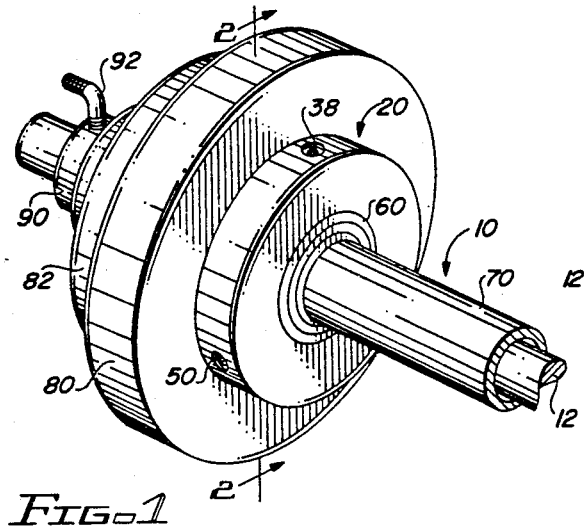
FIG. 1 is a perspective view of weight lifting embodying of the present invention.

FIG. 1 is a perspective view of a portion of weight lifting apparatus 10 which includes a bar 12 to which is secured a collar 20 embodying the present invention. The apparatus includes a bearing assembly 60 secured to the collar 20 and a sleeve 70 secured to the bearing assembly 60 and disposed over the bar 12. That is, the bar 12 extends through the sleeve to and through a pair of collars 20 on opposite ends of the sleeve 70. For convenience, only one end of the bar 12 and the sleeve 70 and the weights associated therewith are shown in the drawing. The weight lifting apparatus is, of course, symmetrical.

A pair of weights 80 and 82 are secured to the bar 12 adjacent to the collar 20. The weights 80 and 82 are held onto the bar 12 by an outer collar 90. The outer 90 is in turn secured to the bar 12 by means of a set screw 92 which extends through the collar 90.

Figure 2:
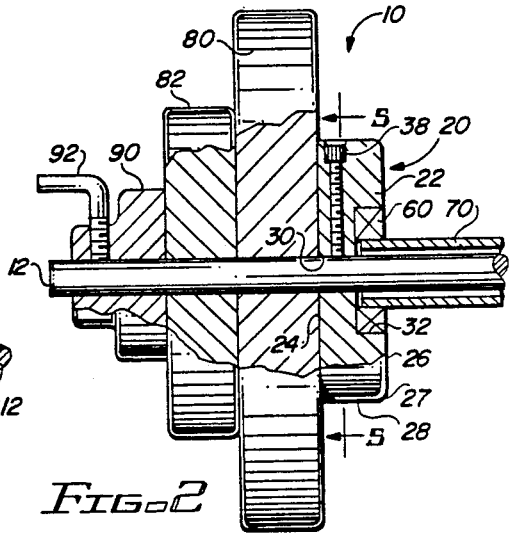
FIG. 2 is a view in partial section taken generally along line 2—2 of FIG. 1.
Figure 3:
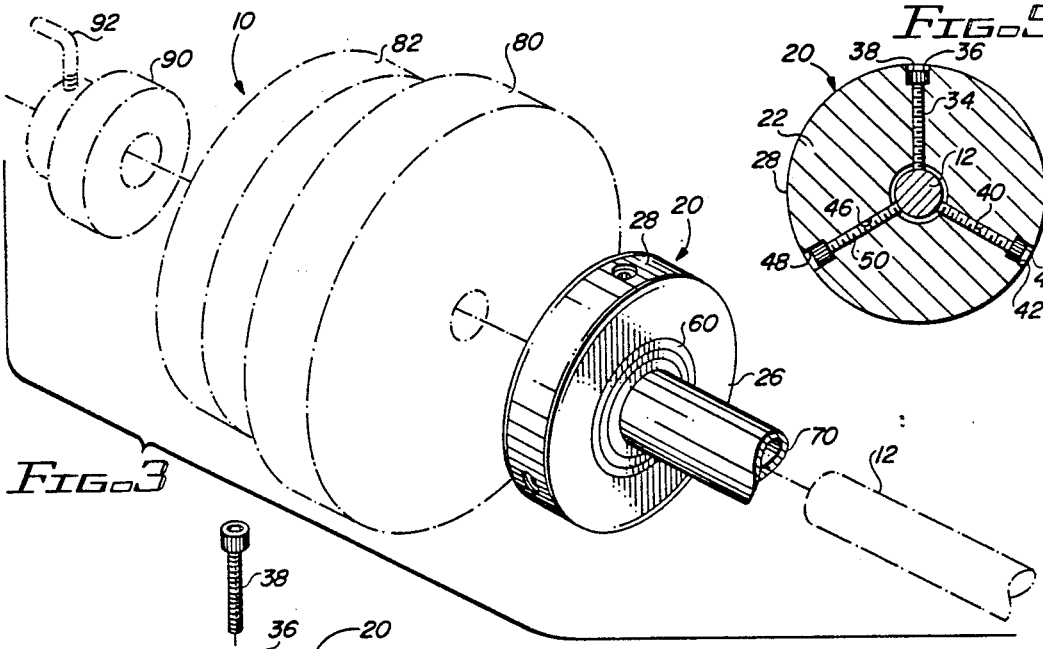
FIG. 3 is an exploded perspective view of the weight lifting apparatus including the apparatus of the present invention.

FIG. 2 is a side view in partial section of the weight lifting apparatus 10 of FIG. 1 taken generally along line 2—2 of FIG. 1. FIG. 3 is an exploded perspective view of the weight lifting apparatus 10. with the bar 12, the weights 80 and 82, and the collar 90 and its set screw 92 shown in dotted line. The collar 20 and the sleeve 70 are shown in perspective in their relationship to the bar 12 and to the weight 80 and the collar 90.

Figure 5:
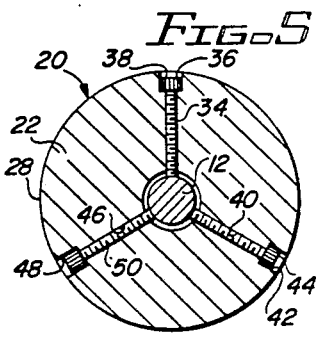
FIG. 5 is a view in partial section taken generally along line 5—5 of FIG. 2.
Figure 4:
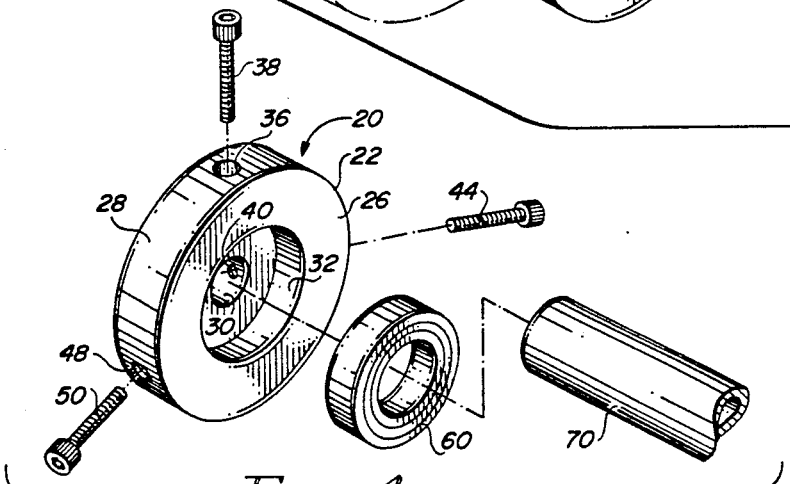
FIG. 4 is an exploded perspective view of the apparatus of the present invention.

FIG. 4 is an exploded perspective view of the collar 20 and the elements associated with the collar 20. FIG. 5 is a view in partial section through the collar 20, taken generally along line 5—5 of FIG. 2.

For the following discussion of the weight lifting apparatus 10, and particularly of the collar 20 and its associated elements, including the sleeve 70, reference will be made to all five of the figures.

The bar 12 is a standard or conventional weight lifting bar to which or on which a plurality of weights may be secured for allowing a user to perform weight lifting exercises. Only one end of the bar is illustrated, for purposes of clarity. It will be understood that a substantially indentical group of elements is also secured to the opposite end of the bar 12. In the alternative, rather than a relatively long bar used for two handed exercising, the weight lifting apparatus 10 may be a relatively short bar or dumbbell to which weights may be secured for one handed exercising. Regardless of whether a dumbbell type short bar is used or a conventional long bar, the elements involved in the apparatus of the present invention are substantially the same.

The collar 20 includes a generally circular disc 22 which includes a relatively flat back or rear side 24 and a relatively flat front side 26. The weight 80 is shown disposed against the back or rear side 24.

The circular disc 22 also includes an outer periphery 28. The outer periphery is, of course, relatively circular. Between the outer periphery 28 and the front side 26 is a chamfered or rounded edge 27.

A bore 30 extends through the disc 22. The bore 30 is appropriately sized to receive the bar 12. The weights 80 and 82, and the over collar 90 are in turn secured to the bar 12 outwardly from the collar 20. As is well known and understood, the weights and over collars include a central bore for receiving a weight lifting bar. The bore 30 accordingly has a slightly larger diameter than that of the bar 12, likewise, the diameters of the weights 80 and 82 and the collar 90 are slightly larger than the diameter of the bar 12.

The collar 20 also includes a centerbore 32 coaxially aligned with the bore 30. The counterbore 32 has a substantially larger diameter than the bore 30. The counterbore 32 receives a bearing assembly 60.

Extending radially through the disc 22, and communicating with the bore 30, are three radial bores, includes a radial bore 34, and radial bore 40, and a radial bore 46. The radial bores 34., 40, and 46 are equally spaced apart, and thus are spaced at about 120 degree intervals.

Extending inwardly from the periphery 28 of the disc 22 at the bores 34, 40, and 46 are three counterbores. The counterbores, are coaxially aligned with their respective bores. The radial bore 34 includes a counterbore 36, the bore 40 includes a counterbore 42, and the bore 46 includes a counterbore 48.

A screw is disposed in each of the three bores, with the head of each screw disposed in the respective counterbores. A screw 38 is disposed in the bore 34, a screw 44 is disposed in the bore 40, and a screw 50 is disposed in the bore 46. The purpose of the screws is to secure the collar 20 to the bar 12. This is best shown in FIG. 5.

The bearing assembly 60 is disposed in the counterbore 32, and thus extends into the disc 22 from the front side 26. The sleeve 70 is press fitted into the bearing 60. The bearing 60 is in turn press fitted into the counterbore 32 of the disc 22.

The inner diameter of the sleeve 70 is slightly greater than the outer diameter of the bar 12. The bearing assembly 60, to which the sleeve 70 is secured, allows the sleeve 70 to rotate independently relative to the bar 12 and to the weights 80 and 82 and the collars 90 and 20, all of which are appropriately secured to the bar 12. Accordingly, a user of the weight lifting apparatus 10 will be able to use the apparatus 10 without the drag of the weights on the sleeve 70, and accordingly without drag from the weights on the users hands.

Drag from the weights normally accompanies the lifting of weights due to the mass of the bar 12 and the weights 80 and 82, for example, as the weight lifting apparatus 10 is raised and lowered through an arcuate path without the sleeve 70 and collar 20. The sleeve 70, secured to the collar 20, and of course to a mirror image collar, weights, etc., at the opposite end of the bar 12 from that illustrated in the drawing, is not hampered by the inertia due to the weights that tends to cause the bar 12 to rotate as the bar and weights are moved arcuately upwardly and downwardly. Thus, a fluid motion by the user of the apparatus 10 is possible as the user raises and lowers the weight lifting apparatus. The bar 12 and the weights 80, 82, and their opposite or corresponding weights (not shown) on the opposite end of the bar 12 (not shown) rotate independently of the sleeve 70.

What I claim is:

1. Weight lifting apparatus, comprising, in combination:

a bar;

weight means secured to the bar;

collar means secrued to the bar adjacent to the weight means, including a disc, means for securing the disc to the bar, and bearing means secured to the disc; and sleeve means secured to the bearing means and disposed over the bar and rotatable in the bearing means relative to the collar means and to the bar.

2. The apparatus of claim 1 in which the collar means further includes a bore for receiving the bar and a counterbore for receiving the bearing means.

3. The apparatus of claim 2 in which means for securing the disc to the bar includes screw means communicating with the bore.

* * * * *